US009850599B2

(12) United States Patent
Stewart

(10) Patent No.: US 9,850,599 B2
(45) Date of Patent: Dec. 26, 2017

(54) WOVEN TERRY FABRIC WITH CONTROLLED WEIGHT DISTRIBUTION AND ARTICLES MADE THEREFROM

(71) Applicant: Standard Textile Co., Inc., Cincinnati, OH (US)

(72) Inventor: Richard Stewart, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 14/863,602

(22) Filed: Sep. 24, 2015

(65) Prior Publication Data

US 2017/0088984 A1 Mar. 30, 2017

(51) Int. Cl.
*D03D 27/08* (2006.01)
*D03D 27/00* (2006.01)

(52) U.S. Cl.
CPC ..... *D03D 27/08* (2013.01)

(58) Field of Classification Search
CPC ..... D03D 27/08; D03D 1/00; D03D 23/00; D03D 27/00; D03D 39/10; D03D 1/0017; D03D 39/22; A41D 13/0015; A41D 2400/10; A41D 2500/20
See application file for complete search history.

(56) References Cited

U.S. PATENT DOCUMENTS 745,112 A 11/1903 Margerison
1,930,769 A * 10/1933 *Parker ..... D03D 27/08 139/396
1,949,579 A * 3/1934 *Parker ..... D03D 27/08 139/25

(Continued)

FOREIGN PATENT DOCUMENTS

GB 105341 A 3/1954
JP 2002173848 A 6/2002

OTHER PUBLICATIONS

International Searching Authority, European Patent Office, International Search Report and Written Opinion issued in corresponding PCT Application No. PCT/US2015/151858, dated Jun. 21, 2016 (12 pages).
International Preliminary Examining Authority, European Patent Office, Written Opinion of the Inernational Preliminary Examining Authority issued in corresponding PCT Application No. PCT/US2015/151858, dated Oct. 26, 2017 (6 pages).

*Primary Examiner* — Bobby Muromoto, Jr.
(74) *Attorney, Agent, or Firm* — Wood Herron & Evans LLP

(57) ABSTRACT

Described is a controlled weight distribution woven terry fabric that includes a body having a first end and a second end, wherein the first and second ends are opposite one another and a first side edge 34 and a second side edge, wherein the first and second side edges are opposite one another and generally perpendicular to the first and second opposite ends. The terry fabric further includes a plurality of zones extending across the fabric between one of the first and second opposite ends or the first and second opposite edges. Each zone of the plurality of zones has a pile with a pile height and the pile height in a zone differs from the pile height in an adjacent zone and the difference between the pile heights in adjacent zones is in a range between about 0.1 mm and about 2 mm. Also described are articles, such as towels, wash cloths, and bath mats, made from the controlled weight distribution woven terry fabric.

22 Claims, 2 Drawing Sheets

(56) References Cited

U.S. PATENT DOCUMENTS 2,546,261 A * 3/1951 Groat ..... D03D 39/10 139/403
2,997,074 A * 8/1961 Law ..... D03D 27/08 139/396
3,030,691 A * 4/1962 Law ..... D03D 27/08 139/396
3,302,665 A * 2/1967 McHargue ..... D03D 27/08 139/25
3,721,272 A * 3/1973 Hager ..... D03D 27/08 139/396
3,721,273 A 3/1973 Sherrill et al.
3,721,274 A 3/1973 Sherrill et al.
4,215,987 A * 8/1980 Mueller ..... D06P 1/0096 8/115
4,315,415 A 2/1982 Wilson
4,315,419 A 2/1982 Kernbichler et al.
4,576,848 A * 3/1986 Dillon ..... D06C 23/02 428/89
4,726,400 A * 2/1988 Heiman ..... D03D 27/08 139/396
4,984,606 A * 1/1991 Moore ..... D03D 27/08 139/25
5,336,543 A * 8/1994 Pyle ..... A47K 10/02 139/383 R
5,447,182 A 9/1995 Gehrig
5,667,865 A 9/1997 Jackson et al.
5,804,274 A * 9/1998 Nordin ..... A47L 13/16 15/208
6,112,773 A * 9/2000 Geiger ..... D03D 39/226 139/26
6,247,505 B1 6/2001 Worman
6,546,965 B2 * 4/2003 Hamby ..... D03D 27/08 139/1 R
6,666,234 B2 * 12/2003 Hamby ..... D03D 27/08 139/396
7,011,116 B2 * 3/2006 Krumm ..... D03D 39/226 139/190
7,044,173 B2 5/2006 Silver
7,273,648 B2 * 9/2007 Morin ..... A47L 13/16 428/88
7,673,656 B2 * 3/2010 Heiman ..... D03D 27/08 139/391
7,743,476 B2 * 6/2010 Rock ..... D04B 1/02 2/69
8,578,972 B2 11/2013 Duan
2005/0081939 A1 * 4/2005 Heiman ..... D03D 27/08 139/25
2014/0115783 A1 5/2014 Rock et al.
2014/0123362 A1 * 5/2014 Seitz ..... A41D 7/008 2/69

* cited by examiner

WOVEN TERRY FABRIC WITH CONTROLLED WEIGHT DISTRIBUTION AND ARTICLES MADE THEREFROM

FIELD

The present invention relates to woven terry fabrics and, more particularly, to woven terry fabrics having controlled weight distribution and articles made therefrom.

BACKGROUND

Woven terry fabric bath and hand towels tend to have a uniform weight distribution from end to end and side to side resulting from a generally uniform construction and height across the length and width of the fabricated finished article. However, during use, it is known that most individuals primarily utilize the central portion of the towel to dry their hands, hair, and bodies, while the ends of the towel are less frequently used for these purposes and more commonly serve to provide a means by which one holds the towel.

Laundering towels consumes significant resources. In particular, towels tend to be made from hydrophilic materials that require significant amounts of detergents or soaps to clean, water to rinse, and heat to dry. Moreover, facilities that pay to process towels and other terry cloth articles on a large scale typically pay according to article weight for laundering services. Reducing the weight of towels could reduce the resources and costs to launder the towels. One way to reduce the weight of a towel is to reduce the pile height in the towel. However, the absorbency of a towel corresponds to the weight of the towel and the total weight of the towel is often a significant influence on the perception of towel quality. As such, a lighter weight towel with a reduced pile height will tend to be less absorbent and will tend to have a less luxurious feel than a heavier weight towel. This can be particularly important in the hospitality industry where patrons often prefer and expect heavy weight towels as a sign of quality and luxury.

SUMMARY

Aspects of the present invention provide an improved terry fabric. Further aspects of the invention provide improved terry fabric articles, such as towels, having desirable drying characteristics and aesthetics while also having a reduced total weight as compared to the weight of the primary area of use, which decreases the resources necessary to manufacture and launder the terry fabric articles. One way to accomplish this is to vary the height of individual rows or groups of pile yarns so as to create a fabric having a controlled, non-uniform distribution of weight either from side to side or end to end. The resulting terry fabric may be utilized to make a terry fabric article, such as a towel, that is woven so that the expected area of primary use, such as the central area of the terry fabric article, has a weight that may be the same or even greater than the weight of a article made from a conventionally woven fabric having a substantially uniform pile height from end to end. However, the fabric results in a terry fabric article that is woven so as to reduce the unit weight in aggregate by decreasing the pile heights of rows or groups of pile that are outside of the primary use of the terry fabric article. Control of the pile height variations could facilitate the weaving and fabrication of terry fabric articles that can be more or less imperceptible from conventionally woven terry fabric articles woven with substantially uniform pile height and weight distribution.

In particular, an aspect of the invention is directed to a terry fabric that includes a body having a first end and a second end that are opposite one another and a first side edge and a second side edge that are also opposite another and generally perpendicular to the first and second opposite ends. The body also includes a plurality of zones extending across the fabric between the first and second opposite ends or the first and second opposite edges. Each zone of the plurality of zones has a pile with a pile height and the pile height in a zone differs from the pile height in an adjacent zone and the difference between the pile heights in adjacent zones is in a range between about 0.1 mm and about 2 mm. The plurality of zones may include a first zone having a lowest pile height and a second zone having a highest pile height and a first plurality of intermediate zones that are intermediate to the first zone and the second zone. The pile heights in each of the first plurality of intermediate zones incrementally increases from adjacent the first zone to adjacent the second zone. The plurality of zones may further include a third zone having a pile height less than the pile height of the second zone and a second plurality of intermediate zones that are intermediate to the third zone and the second zone. The pile heights in each of the second plurality of intermediate zones incrementally increases from adjacent the third zone to adjacent the second zone. In an embodiment, the pile height in at least one zone is less than the pile height in the zones that are on opposite sides of and immediately adjacent to the at least one zone. The fabric may be utilized to produce a terry fabric article, such as a bath mat, a wash cloth, or a towel.

By virtue of the foregoing, there is thus provided a terry fabric, and terry fabric articles made therefrom, having a reduced overall weight as compared to the weight of the primary area of use while maintaining the appearance and utility of a heavier weight conventionally woven terry fabric having uniform weight from edge to edge or end to end. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
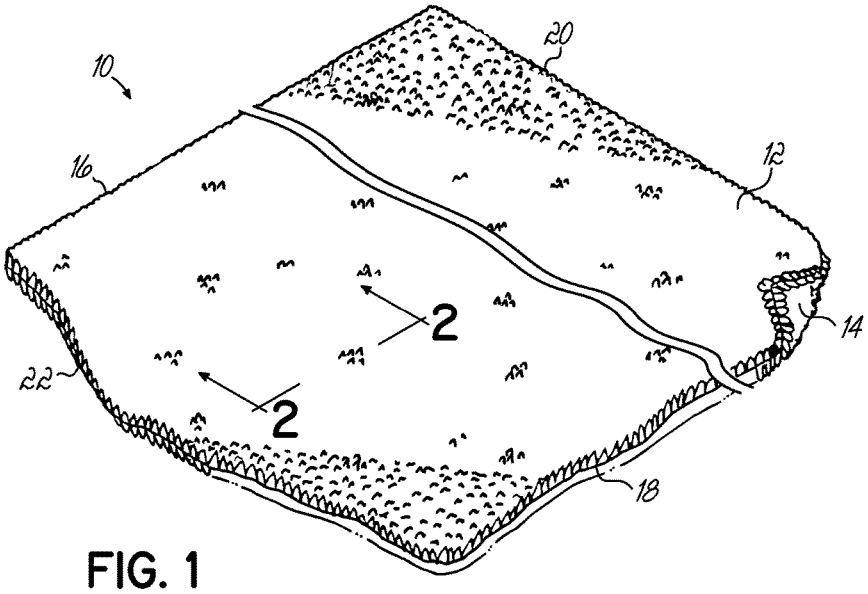
FIG. 1 is a perspective view of a woven terry fabric in accordance with the principles of the invention.
Figure 2:
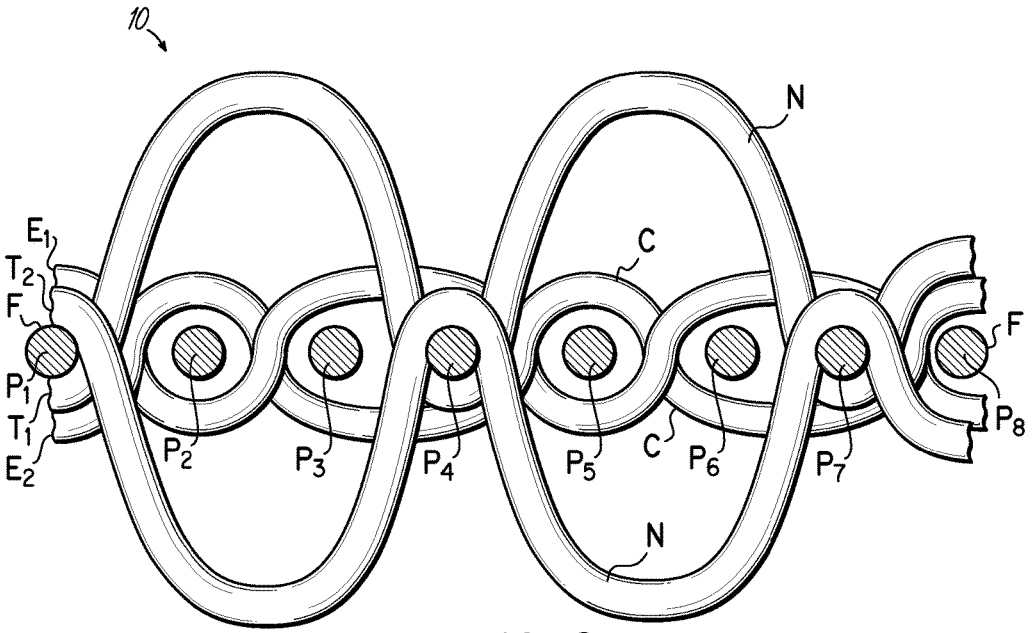
FIG. 2 is a partial, cross-sectional view, not to scale, taken along line 2-2 of FIG. 1.

With reference to FIGS. 1 and 2, a terry fabric 10 is woven in a three-pick terry weave, and includes a top surface 12 and a bottom surface 14, with the surfaces 12, 14 extending between a left selvage 16 and a right selvage 18, as well as a top or trailing end 20 and a bottom or leading end 22. As shown in FIG. 2, the ground warp ends $E_1$, $E_2$ are formed of yarn C, the terry pile loops N are formed of yarns $T_1$, $T_2$, and the ground fill picks $P_1$, $P_2$, $P_3$, $P_4$, $P_5$, $P_6$, $P_7$, $P_8$ are formed of yarn F. The ground warp ends $E_1$, $E_2$ and the ground fill picks $P_1$, $P_2$, $P_3$, $P_4$, $P_5$, $P_6$, $P_7$, $P_8$ form the ground fabric. The terry pile loops N form the pile that projects from the surface of the ground fabric. As seen in FIG. 2, the ground warp yarn C, terry pile loop yarn $T_1$, $T_2$, and ground fill yarn F are woven together in a three-pick terry weave. Although FIG. 2 illustrates part of a single warpwise row, the ground warp ends and terry pile loops of the other rows of the terry fabric 10 may be constructed and arranged as shown in FIG. 2.

Figure 3:
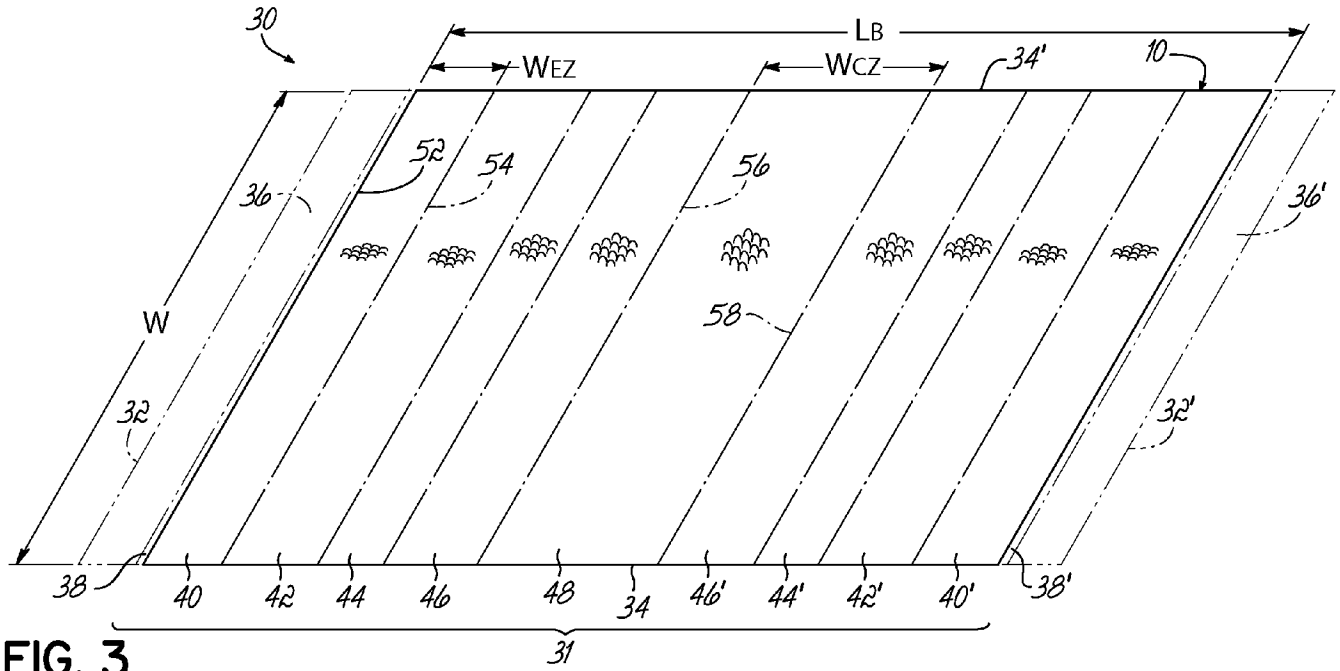
FIG. 3 is a perspective view of a schematic representation of a terry fabric towel in accordance with the principles of the invention.
Figure 4:
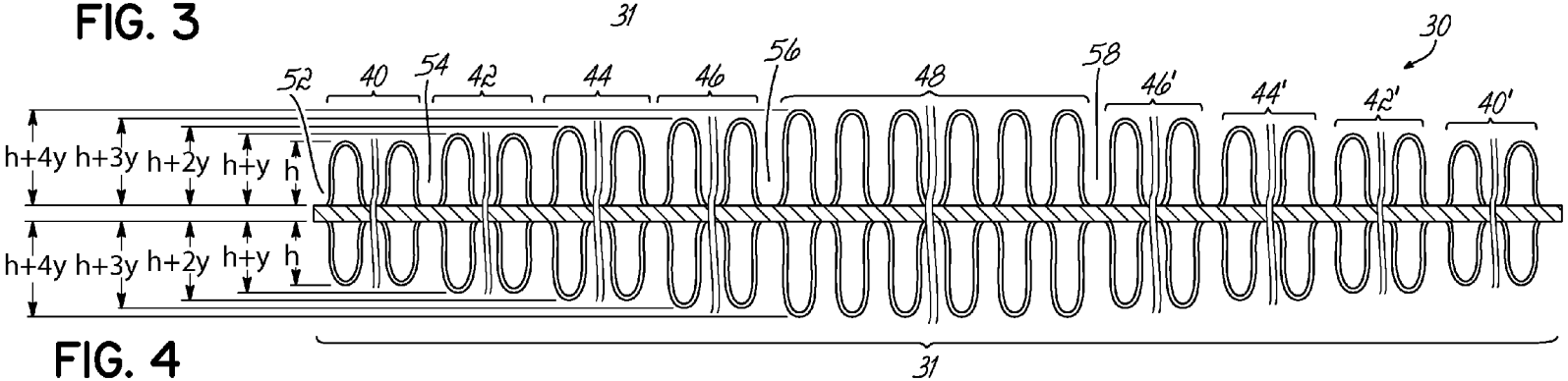
FIG. 4 is a partial, cross-sectional view, not to scale, of a portion of the terry fabric towel of FIG. 3.

While not readily apparent upon casual visual inspection, the terry fabric 10 illustrated in FIG. 1 is woven with a plurality of zones extending across the fabric wherein the pile height in each zone is slightly higher or lower than the pile height in an adjacent zone. FIG. 3 illustrates an exemplary embodiment of a terry fabric article, in particular, a towel 30 formed from the terry fabric 10 with dashed lines indicating otherwise non-apparent transitions between zones. FIG. 4, which is not drawn to scale, is a partial cross section of the towel 30 of FIG. 3 illustrating the differences in pile height between adjacent zones of terry fabric 10.

The exemplary towel 30 in FIGS. 3 and 4 has a body 31 with a length $L_B$ extending between the opposite ends 32, 32' of the towel 30 and a width W extending between opposite side edges 34, 34' of the towel 30. In the illustrated embodiment, the terry fabric 10 of towel 30 includes optional opposite end sections 36, 36' that are separated from the body 31 of the towel 30 by a pair of optional border sections 38, 38'. The body 31 of the towel 30 is illustrated as being divided into a plurality of zones 40, 40', 42, 42', 44, 44', 46, 46', and 48 that each extend across the width of the towel. It will be appreciated that the terry fabric 10 could be formed in which the zones 40, 40', 42, 42', 44, 44', 46, 46', and 48 extend across the length $L_B$ of the body 31 of the towel 30 instead of the width W. It will be further appreciated that the towel 30 may be formed without the optional end sections 36, 36' or the optional border sections 38, 38'. Moreover, it will be appreciated that the towel 30 may include a hem and a selvage or both around the sides edges 34, 34' and opposite ends 32, 32' and that references herein to extending to the ends 32, 32' and/or edges 34, 34' of the towel 30 contemplates extending to beginning of the hems and/or selvage.

In the illustrated embodiment, the pile in the end zones 40, 40' of the body 31 of the towel 30 adjacent to the border sections 38, 38' have a height h that is the shortest pile in the towel 30. In the first intermediate zones 42, 42' that are adjacent to the end zones 40, 40', the pile height h increases by an increment y that is not readily apparent upon casual visual inspection. The pile height in the first intermediate zones 42, 42' is thus equal to h+y. In the second intermediate zones 44, 44' that are adjacent to the first intermediate zones 42, 42', the pile height increases by another increment, designated here as 2y, relative to the pile height $h_{PZ}$ in the preceding zones, (i.e., first intermediate zones 42, 42'). The pile height in the second intermediate zones 44, 44' is thus equal to $h_{PZ}$+2y. In the third intermediate zones 46, 46' that are adjacent to the second intermediate zones 44, 44', the pile height increases by another increment, designated here as 3y, relative to the pile height $h_{PZ}$ in the preceding zones (i.e., second intermediate zones 44, 44'). The pile height in the third intermediate zones 46, 46' is thus equal to $h_{PZ}$+3y. In the central zone 48 that is adjacent to the third intermediate zones 46, 46', the pile height increases by another increment, designated here as 4y, relative to the pile height $h_{PZ}$ in the preceding zones (i.e., third intermediate zones 46, 46'). The pile height in the central zone 48 is thus equal to $h_{PZ}$+4y. The central zone 48 has the highest pile height in the body 31 of the towel 30.

While the incremental increases y, 2y, 3y, 4y in pile height h, $h_{PZ}$ are illustrated as being the same across all zones 40, 40', 42, 42', 44, 44', 46, 46', 48, it will be appreciated that the incremental increases in pile height between adjacent zones need not be identical across all zones. For example, the incremental increase y in pile height between the end zones 40, 40' and the first intermediate zones 42, 42' may equal a first value and the incremental increase 2y between the first intermediate zones 42, 42' and the second intermediate zones 44, 44' may be a second value that is greater or smaller than the first value so long as the incremental increase y, 2y, 3y, 4y between adjacent zones 40, 40', 42, 42', 44, 44', 46, 46', 48 is not readily apparent upon casual visual inspection of the body 31 of the towel 30. The pile heights in the optional end sections 36, 36' and optional border sections 38, 38' may be less than, greater than, or equal to the pile heights of one or more of the zones 40, 40', 42, 42', 44, 44', 46, 46', 48 of the body 31 of the towel 30.

As described above, the differences (i.e., incremental increases y, 2y, 3y, 4y) between the pile heights h, $h_{PZ}$ in adjacent zones 40, 40', 42, 42', 44, 44', 46, 46', 48 of the body 31 of the towel 30 are small enough that the differences are not readily apparent upon casual visual inspection of the towel 30. In an embodiment, the difference in pile height between adjacent zones may range between about 0.1 mm and about 2 mm. In another embodiment, the difference in pile height between adjacent zones may range between about 0.1 mm and about 1.5 mm. In another embodiment, the difference in pile height between adjacent zones may range between about 0.1 mm and about 1 mm. In another embodiment, the difference in pile height between adjacent zones may range between about 0.1 mm and about 0.8 mm. In another embodiment, the difference in pile height between adjacent zones may range between about 0.1 mm and about 0.6 mm. In another embodiment, the difference in pile height between adjacent zones may range between about 0.1 mm and about 0.5 mm. In another embodiment, the difference in pile height between adjacent zones may range between about 0.1 mm and about 0.4 mm. In another embodiment, the difference in pile height between adjacent zones may range between about 0.1 mm and about 0.3 mm. In another embodiment, the difference in pile height between adjacent zones may range between about 0.1 mm and about 0.2 mm. In another embodiment, the difference in pile height between adjacent zones may range between about 0.2 mm and about 0.4 mm. In another embodiment, the difference in pile height between adjacent zones may range between about 0.3 mm and about 0.4 mm.

In the illustrated embodiment, the central zone 48 has the highest pile height in the body 31 of the towel 30. In an embodiment, the pile height in the zone with the highest pile height is not less than about 110% or more than about 300% of the pile height in the zone with the lowest pile height. In an embodiment, the pile height in the zone with the highest pile height is not less than about 125% or more than about 250% of the pile height in the zone with the lowest pile height. For example, if the pile height in the end zones 40, 40' of the illustrated embodiment is about 10 mm, the pile height of the central zone may range between about 12.5 mm and about 25 mm. In another embodiment, the pile height in the zone with the highest pile height is not less than about 125% or more than about 200% of the pile height in the zone with the lowest pile height.

In an embodiment, the heights of the pile, measured as the distance that the pile projects from the ground fabric, may range from between about 5 mm and about 10 mm. If the terry has double sided pile, the total thickness of the pile from both sides of the fabric may range between about 10 mm and about 20 mm.

The pile height may also be considered as a function of the terry ratio, which is an expression of the length of yarn consumed for the pile as compared to the ground warp. In an embodiment of the invention, the fabric may have a terry ratio which ranges between about 3:1 and about 12:1. In another embodiment, the fabric may have a terry ratio which ranges between about 5:1 and 11:1.

In the illustrated embodiment, end zone 40, first intermediate zone 42, the second intermediate zone 44, the third intermediate zone 46, and the central zone 48 each have a different pile height with the end zone 40 having the lowest pile height and the central zone 48 having the highest pile height. These pile heights correspond with the pile heights in the zones at the opposite end of the towel, i.e., end zone 40', first intermediate zone 42', the second intermediate zone 44', the third intermediate zone 46'. Thus, the illustrated embodiment utilizes five different pile heights spread across the end zones 40, 40', intermediate zones 42, 42', 44, 44', 46, 46', and the central zone 48. It will be appreciated that a different number of zones, each having a different pile height relative to their respective adjacent zones may be used. In an embodiment, at least four zones from the end zones to the central zone having four different pile heights are used. In another embodiment, at least eight zones from the end zones to the central zone having eight different pile heights are used. In another embodiment, at least twelve zones from the end zones to the central zone having twelve different pile heights are used. In another embodiment, at least sixteen zones from the end zones to the central zone having sixteen different pile heights are used. In another embodiment, at least twenty zones from the end zones to the central zone having twenty different pile heights are used. In another embodiment, the number of zones between the end zones and the central zone may range between four zones and thirty-two zones. In another embodiment, the number of zones between the end zones and the central zone may range between ten zones and thirty zones. In another embodiment, the number of zones between the end zones and the central zone may range between sixteen zones and thirty zones. In another embodiment, the number of zones between the end zones and the central zone may range between twenty zones and thirty zones.

Furthermore, while the illustrated towel 30 has a central zone 48 surrounded by an equal number of intermediate zones 42, 42', 44, 44', 46, 46' between the central zone 48 and the two end zones 40, 40', the towel 30 could have an unequal number of intermediate zones between the central zone 48 and the end zones 40, 40'. For example, in an embodiment, the first end 32 of the towel 30 may include end zone 40 and a first plurality of intermediate zones and the second end 32' of the towel 30 may include second end zone 40' and a second plurality of intermediate zones, and the number of zones in the first plurality of intermediate zones may be different from the number of zones in the second plurality of intermediate zones.

It will be further appreciated that the towel 30 could have a zone at the first end 32 with the shortest pile height and a second zone at the opposite end 32' with the highest pile height and a plurality of intermediate zones with piles heights that incrementally increase from the zone at the first end 32 to the zone at the second end 32' such that the difference between pile heights in adjacent zones is not be readily apparent upon casual visual inspection.

It is further contemplated that the pile heights in adjacent zones may not necessarily increase from one zone to the next across a plurality of zones. In other words, the pile heights across a plurality of zones may alternate between lower pile heights and higher pile heights. For example, the towel illustrated in FIG. 3 could be produced such that the pile heights in zones 40 and 44 are higher or lower than the pile height in zones 42 and 46. This pattern of alternating pile heights could continue along the entire length $L_B$ of the body 31 of the towel 30 or along a portion of the length of the towel 30. To exemplify this latter point, the pile heights could alternate in the end zones 40, 40', the first intermediate zones 42, 42' and the second intermediate zones 44, 44' and then the pile heights could increase incrementally from the second intermediate zones 44, 44' across the third intermediate zones 46, 46' to the central zone 48. These alternative embodiments maintain the spirit of the invention that the difference between pile heights in adjacent zones is not readily apparent upon casual visual inspection.

Between each zone 40, 40', 42, 42', 44, 44', 46, 46', 48 is a transition from the pile height in one zone to the pile height in the adjacent zone. The distance between the transitions from one zone to the next zone defines the widths of each zone. For example, the width $W_{EZ}$ for end zone 40 is defined as the distance between transition 52 to the optional border section 38 and transition 54 to the first intermediate zone 42. And, the width $W_{CZ}$ for the central zone 48 is defined as the distance between the transitions 56, 58 to the third intermediate zones 46, 46'. In an embodiment, the width $W_{CZ}$ of the central zone 48 may be wider than the width of the end zones 40, 40' and the intermediate zones 42, 42', 44, 44', 46, 46'. In another embodiment, the width $W_{CZ}$ is about equal to the width of one or more of the end zones 40, 40' and the intermediate zones 42, 42', 44, 44', 46, 46'. In an embodiment, none of the individual zones (i.e., the individual end zones 40, 40', intermediate zones 42, 42', 44, 44', 46, 46', or central zone 48) has a continuous width that is more than about 25% of the overall length $L_B$ of the body 31 of the towel 30. In another embodiment, the width of the individual zones (i.e., the individual end zones 40, 40', intermediate zones 42, 42', 44, 44', 46, 46', or central zone 48) ranges between about 1% and about 25% of the overall length $L_B$ of the body 31 of the towel 30. In another embodiment, the width of the individual zones (i.e., the individual end zones 40, 40', intermediate zones 42, 42', 44, 44', 46, 46', or central zone 48) ranges between about 2% and about 15% of the overall length $L_B$ of the body 31 of the towel 30.

In another embodiment, the width of the central zone 48 is greater than the width of any one of the end zones 40, 40' or intermediate zones 42, 42', 44, 44', 46, 46' and is not more than about 25% of the overall length $L_B$ of the body 31 of the towel 30. In this same embodiment, the width of the end zones 40, 40' and intermediate zones 42, 42', 44, 44', 46, 46' may range between about 1% and about 10%, or, alternatively between about 2% and about 5% of the overall length $L_B$ of the body 31 of the towel 30. In a towel exemplifying this embodiment that has a length of about 50 inches, the widths of the end zones 40, 40' and intermediate zones 42, 42', 44, 44', 46, 46' may range from between about 0.5 inch and about 5 inches and the width $W_{CZ}$ of the central zone 48 would not be more than about 12.5 inches. Of course, intermediate zones in addition to the illustrated intermediate zones 42, 42', 44, 44', 46, 46' may be necessary to span to the distance from the end zones 40, 40' to the central zone 48.

In another embodiment, the width of the third intermediate zones 46, 46' immediately adjacent to the central zone 48 may be greater than the width of the end zones 40, 40' and the remaining intermediate zones 42, 42', 44, 44'. For example, the central zone 48 may have a width $W_{CZ}$ that ranges between 5 times and 10 times the widths of the individual end zones 40, 40' and first and second intermediate zones 42, 42', 44, 44' and the third intermediate zones 46, 46' immediately adjacent the central zone 48 may have a width that ranges between about 3 times and about 6 times the width of the individual end zones 40, 40' and first and second intermediate zones 42, 42', 44, 44'.

The yarns defining the ground fill, ground warp, and pile warp of embodiments of the terry fabric 10 may be made of any suitable material including yarns made of natural material, synthetic material, and combinations thereof. In an embodiment, at least a portion of the yarns include hydrophilic fibers, such as cotton or other cellulosic fibers that may optionally be blended with synthetic yarns such as polyester in spun or filament yarn form. Such yarns are known in the art. Further, depending upon the desired characteristic of the fabric the ground fill and ground warp may be selected of appropriate materials and the pile warp may be selected of the same or different materials, likewise any combination of yarns may be utilized to define the ground fill, ground warp, and pile warp as desired.

The terry fabrics described herein may be used to manufacture any sort of terry fabric article, such as bath mats, wash cloths, and towels including bath sheets, bath towels, hand towels, and dish towels.

As the fabric is woven, the pile height for each zone 40, 40', 42, 42', 44, 44', 46, 46', 48 of the body 31 of the towel 30 is woven to have the desired height. In an embodiment, terry fabric is woven on a terry loom capable of weaving the terry fabric with the desired pile height in each zone. In an embodiment, the terry loom weaves a different pile height for every 48 to 96 pick insertions, which corresponds to about 16 loops to about 32 loops at the desired height in the zone over a distance of about 1 inch to about 2 inches. The number of pick insertions and corresponding loops per zone may be adjusted as necessary to result in zones having the desired widths as discussed above.

The incremental increases y, 2y, 3y, 4y in pile height from the end zones 40, 40' to the central zone 48 result in a towel 30 wherein the difference in the pile height in the end zones 40, 40' of the towel 30 compared to the central zone 48 will not be readily apparent to the user of the towel 30 upon casual visual inspection. Moreover, since most people dry themselves with the central area of towels, which corresponds to the central zone 48 of the presently described towel 30, most people using the resulting towels 30 will experience the same performance qualities as they would experience if the towel 30 had been woven with a uniform pile height from end to end 32, 32' that matches the pile height in the central zone 48. The resulting towel 30 has the further benefit of requiring less material to manufacture as less yarn will be needed to weave the fabric for the towel 30 due to the lower average pile heights. Further, the lower average pile heights will decrease the weight of the towels 30 which will decrease the resources necessary for laundering the towels 30. This has environmental consequences as less soap and water will be necessary to wash the towels 30 and less energy will be needed to dry the towels 30. This is especially helpful in institutional settings wherein laundering is paid based on the weight of the laundered items. The significant weight reductions in the towel will result in significant savings for institutional users of the towel 30, such as hotels and hospitals, which launder large quantities of towels 30 every day. Thus, the resulting towel 30 provides the same user benefits as heavier towels while reducing the resources required to manufacture and launder the towel 30.

By virtue of the foregoing, there is thus provided a woven terry fabric 10 with controlled weight distribution and terry fabric articles, such as towel 30, having advantages over prior woven terry fabrics and terry fabric articles.

While the present invention has been illustrated by the description of embodiments thereof and specific examples, and while the embodiments have been described in considerable detail, it is not intended to restrict or in any way limit the scope of the appended claims to such detail. Additional advantages and modifications will readily appear to those skilled in the art. For example, although the drawings illustrate a three-pick terry-weave pattern, any suitable pattern may be used to form the woven terry fabric. It is further contemplated that the towel could include one or more zones that include a continuous or near continuous increase in pile height from one row of pile loops to the next so long as the difference between pile heights is not readily apparent upon casual visual inspection. Additionally, if more than one yarn type is used in the warp, any desired sequence or pattern of spun yarn and/or synthetic filament yarn may be used. Also, the woven terry fabric may include synthetic fibers, filaments, and/or yarns in the pile loops, with the synthetic material being polyester and/or other suitable synthetic material(s). In addition, while the pile is illustrated herein as a loop pile, cut pile could also be used and is within the scope of the invention. Thus, the invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A woven terry fabric comprising:

a body including a first end and a second end, wherein the first and second ends are opposite one another, a first side edge and a second side edge, wherein the first and second side edges are opposite one another and generally perpendicular to the first and second opposite ends, and a plurality of zones extending across the fabric between one of the first and second opposite ends or the first and second opposite side edges, wherein the plurality of zones includes a first zone adjacent one of the first end or first edge and a second zone adjacent the opposite second end or second edge, a central zone intermediate to the first zone and the second zone, a first plurality of intermediate zones between the first zone and the central zone, and a second plurality of intermediate zones between the second zone and the central zone, and further wherein each zone of the plurality of zones has a pile with a pile height that differs from the pile height in adjacent zones and the pile height in each zone of the first plurality of intermediate zones is greater than the pile height in the first zone and less than the pile height in the central zone, and the pile height in each zone of the second plurality of intermediate zones is greater than the pile height in the second zone and less than the pile height in the central zone, and the difference in pile height between adjacent zones is in a range between 0.1 mm and 2 mm and the central zone has a pile height that is not less than 110% of the pile height in each of the first and second zones and is not more than 300% of the pile height in each of the first and the second zones.

2. The woven terry fabric of claim 1 wherein the first zone has a lowest pile height and central zone has a highest pile height and the pile height in each of the first plurality of intermediate zones that are intermediate to the first zone and the central zone incrementally increases from adjacent the first zone to adjacent the central zone.

3. The woven terry fabric of claim 2 wherein the first plurality of intermediate zones includes at least three intermediate zones.

4. The woven terry fabric of claim 2 wherein the first plurality of intermediate zones is in a range between three intermediate zones and thirty intermediate zones.

5. The woven terry fabric of claim 2 wherein the width of the second zone is not greater than 25% of the length of the body and the width of the remaining zones is in a range between 1% to 25% of the length of the body.

6. The woven terry fabric of claim 2 wherein the second zone has a pile height less than the pile height of the central zone and the pile height in each of the second plurality of intermediate zones incrementally increases from adjacent the second zone to adjacent the central zone.

7. The woven terry fabric of claim 6 wherein the second plurality of intermediate zones includes at least three intermediate zones.

8. The woven terry fabric of claim 6 wherein the second plurality of intermediate zones is in a range between three intermediate zones and thirty intermediate zones.

9. The woven terry fabric of claim 1 wherein a difference between the pile height in adjacent zones is in a range between 0.1 mm and 0.6 mm.

10. The woven terry fabric of claim 1 wherein the pile height, measured as the distance that the pile projects from one side of the ground fabric, is in a range between 5 mm and 10 mm.

11. The woven terry fabric of claim 1 wherein the fabric includes a first length of yarn in the pile and a second length of yarn in the ground warp and the ratio of the length of yarn in the pile to the length of yarn in the ground warp is in a range between 3:1 and 12:1.

12. The woven terry fabric of claim 1 wherein the body has a length and a width and each of the plurality of zones has a length and a width that are generally perpendicular to the length and width of the body and the width of each the plurality of zones is not greater than 25% of the length of the body.

13. The woven terry fabric of claim 1 wherein the width of each the plurality of the zones is in a range between 1% to 25% of the length of the body.

14. A terry fabric article comprising the terry fabric of claim 1.

15. The terry fabric article of claim 14 wherein the terry fabric article is selected from the group consisting of a bath mat, a wash cloth, and a towel.

16. The terry fabric article of claim 15 wherein the towel is selected from the group consisting of a bath sheet, a bath towel, a hand towel, and a dish towel.

17. The terry fabric article of claim 14 further comprising a first end section adjacent the first end of the body and a second end section adjacent the second end of the body.

18. The terry fabric article of claim 17 further comprising a first border section intermediate to the first end section and the first end of the body and a second border section intermediate to the second end section and the second end of the body.

19. A method of weaving the terry fabric of claim 1 comprising weaving a terry fabric having a plurality of zones extending across the fabric between one of the first and second opposite ends or the first and second opposite side edges, wherein the plurality of zones includes a first zone adjacent one of the first end or first edge and a second zone adjacent the opposite second end or second edge, a central zone intermediate to the first zone and the second zone, a first plurality of intermediate zones between the first zone and the central zone, and a second plurality of intermediate zones between the second zone and the central zone, and further wherein each zone of the plurality of zones has a pile with a pile height that differs from the pile height in adjacent zones and the pile height in each zone of the first plurality of intermediate zones is greater than the pile height in the first zone and less than the pile height in the central zone, and the pile height in each zone of the second plurality of intermediate zones is greater than the pile height in the second zone and less than the pile height in the central zone, and the difference in pile height between adjacent zones is in a range between 0.1 mm and 2 mm and the central zone has a pile height that is not less than 110% of the pile height in each of the first and second zones and is not more than 300% of the pile height in each of the first and the second zones.

20. The woven terry fabric of claim 1 wherein the pile height in the first zone is equal to the pile height in the second zone.

21. The woven terry fabric of claim 1 wherein the differences in pile height between adjacent zones is not readily apparent upon casual visual inspection.

22. The method of claim 19 wherein the differences in pile height between adjacent zones is not readily apparent upon casual visual inspection.

* * * * *